US005118992A

United States Patent [19]

Szuba

[11] Patent Number: 5,118,992

[45] Date of Patent: Jun. 2, 1992

[54] FLUORESCENT LAMP CONTROLLING ARRANGEMENT

[75] Inventor: Stefan F. Szuba, Park Ridge, Ill.

[73] Assignee: North American Philips Corporation, New York, N.Y.

[21] Appl. No.: 510,508

[22] Filed: Apr. 17, 1990

[51] Int. Cl.[5] ..... H05B 41/36

[52] U.S. Cl. ..... 315/158; 250/214 D; 368/11

[58] Field of Search ..... 315/158, 150, 156, 157; 250/208, 214 R, 214 D; 350/34 C; 340/717, 767; 368/10

[56] References Cited

U.S. PATENT DOCUMENTS 3,345,536 10/1967 Atkins et al. ..... 250/214 D
3,777,225 12/1973 Dixon ..... 250/214 D
4,114,366 9/1978 Renner et al. ..... 315/156
4,417,179 11/1983 Fujimura et al. ..... 315/151
4,464,606 8/1984 Kane ..... 315/158
4,663,570 5/1987 Luchaco et al. ..... 315/159
4,712,923 12/1987 Martin ..... 368/10
4,868,459 9/1989 Dennerlein et al. ..... 315/158

FOREIGN PATENT DOCUMENTS 2426382 11/1975 Fed. Rep. of Germany .
987077 3/1965 United Kingdom .

*Primary Examiner*—Eugene R. Laroche
*Assistant Examiner*—Son Dinh
*Attorney, Agent, or Firm*—Robert T. Mayer

[57] ABSTRACT

A method for controlling the luminescence of a fluorescent lamp in which a light sensor operates in response to light other than that from the fluorescent lamp striking it to increase the luminescence of the lamp.

13 Claims, 2 Drawing Sheets

FLUORESCENT LAMP CONTROLLING ARRANGEMENT

This is an invention in the lighting art. More particularly, it involves an arrangement by which a fluorescent lamp may be controlled in accordance with the amount of ambient light incident, or falling upon, at least a part of the area in which the fluorescent lamp is located.

This invention is related to that disclosed in U.S. patent application Ser. No. 358,257 of John M. Wong and Michael Kurzack, filed on May 26, 1989 under the title "Fluorescent Lamp Controllers With Dimming Control" and assigned to the same assignee as this application, now U.S. Pat. No. 5,003,230. Application Ser. No. 358,257 and all matters incorporated by reference therein is hereby incorporated by reference herein.

This invention is also related to that disclosed in U.S. patent application Ser. No. 403,222 of Stefan F. Szuba filed Sep. 5, 1989 under the title "Dimmer Control Circuit" and assigned to the same assignee as this application. That application and all matters incorporated by reference therein are also incorporated by reference herein.

One of the objects of this invention is the conservation of energy. In liquid crystal displays backlighting is used to provide contrast between the ambient light incident upon the display and the display itself. This invention controls the amount of light from fluorescent lamps used as such backlighting in accordance with the amount of ambient light incident on the display. It conserves energy by reducing the luminescence of a backlighting fluorescent lamp as the incident ambient light decreases.

One of the features of the invention is that it provides a more effectual control for fluorescent lamps than previous arrangements.

It is a feature of the invention that it enables the control of the amount of fluorescent light used as backlighting for a liquid crystal display in a more efficient manner than previously.

In accordance with one aspect of the invention there is provided a method of controlling the amount of luminescence provided by a lamp used for backlighting a crystal display. The method includes sensing the amount of light incident on the display other than that provided by the lamp. The method increases the luminescence provided by the lamp as the incident light other than that provided by the lamp increases.

In accordance with another aspect of the invention, there is provided a sensing circuit for a fluorescent lamp. The sensing circuit is connected to a ballast for the fluorescent lamp which ballast includes a light control circuit for controlling the luminescence of the fluorescent lamp. The sensing circuit includes a light sensor which produces a signal representative of the light impinging upon it. The sensing circuit is operable from power derived from the ballast means and controls the light control circuit so that the luminescence emanating from the fluorescent lamp is increased in accordance with increases in the light striking the light sensor.

Figure 1:
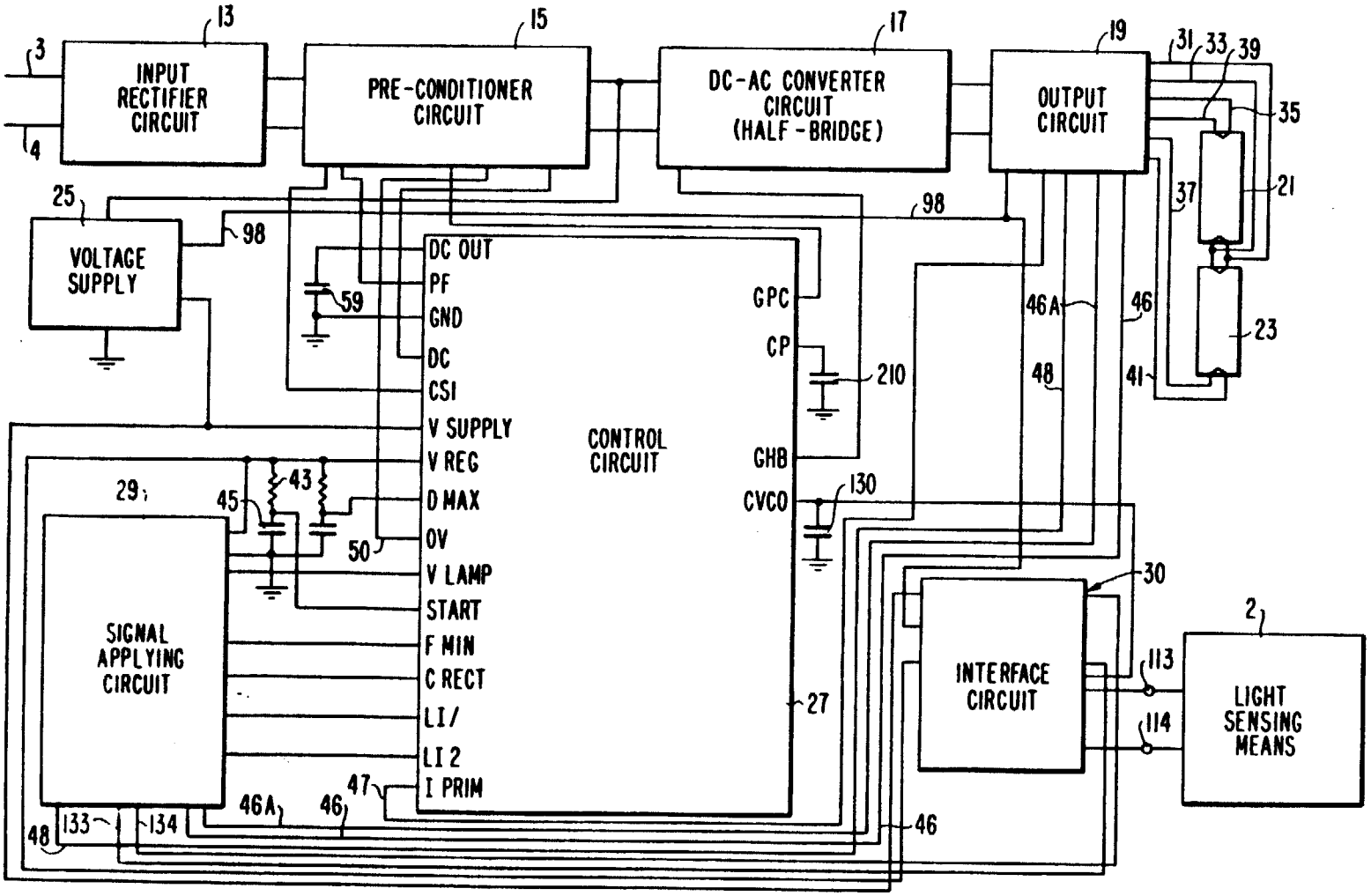
Figure 2:
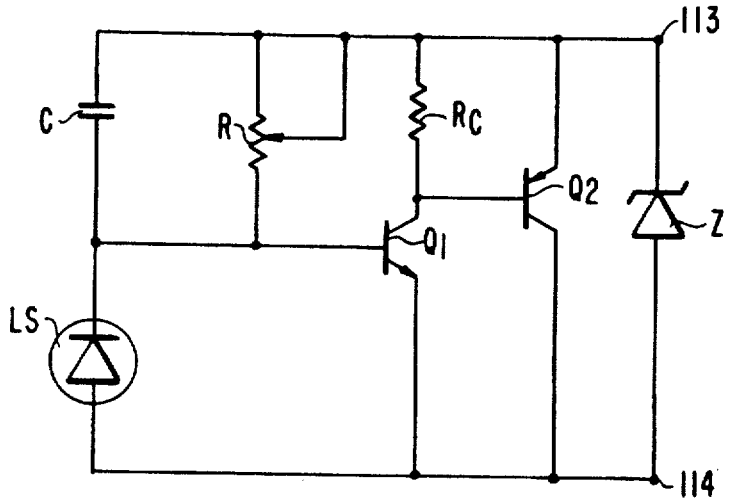
Figure 3:
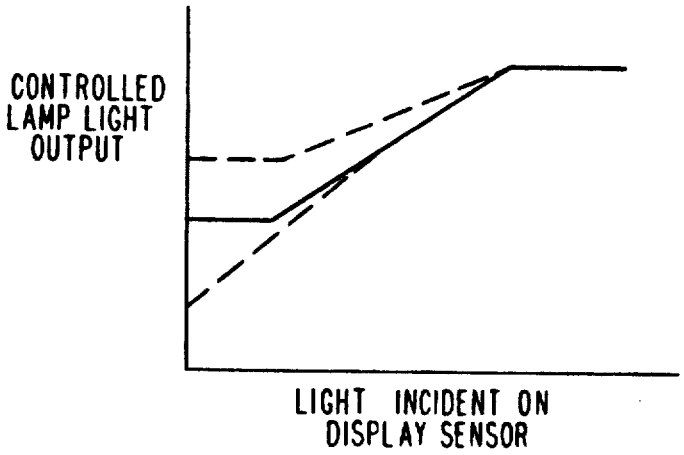

Other objects, features and advantages of the invention will be apparent from the following description and appended claims when considered in conjunction with the accompanying drawing in which, FIG. 1 is a block diagram of a circuit provided in accordance with this invention;

FIG. 2 is the schematic of a light sensing circuit included in the light sensing means of FIG. 1; and FIG. 3 is a family of curves plotting controlled lamp light output against light incident upon a display by which the method of this invention may be practiced.

Except for light sensing means 2 each of the elements shown in FIG. 1 correspond to those disclosed in the aforementioned U.S. patent application Ser. No. 358,257. As a consequence, it is to be understood that the ballast means including the following elements of application Ser. No. 358,257 namely, input rectifier circuit 32, pre-conditioner circuit 28, DC-AC converter circuit 24, output circuit 20, lamps 11 and 12, voltage supply 40, control circuit 36, signal applying circuit 112 and dimming interface circuit 110 correspond respectively to input rectifier circuit 13, preconditioned circuit 15, DC-AC converter circuit 17, output circuit 19, lamps 21 and 23, voltage supply 25, control circuit 27, signal applying circuit 29 and interface circuit 30 of this application.

Assume lines 3 and 4 to input rectifier circuit 13 receive a 120 volt, 60 cycle AC voltage. This AC voltage is rectified by input rectifier 13 which provides a DC voltage to preconditioner circuit 15 with a wave shape that mirrors the AC supply provided along lines 3 and 4.

The wave form received by preconditioner circuit 15 is acted upon by a boost converter contained in circuit 15 to produce a constant DC output voltage. This constant DC voltage is applied to DC-AC converter circuit 17. The DC voltage received by circuit 17 is converted to a high frequency AC voltage. A resident tuned LC circuit in output circuit 19 (see FIG. 2 of the Mark W. Fellows et al U.S. patent application Ser. No. 219,923, filed Jul. 15, 1988 and assigned to the same assignee as this application which illustrates the details of output circuit 19 and which application Ser. No. 219,923 is hereby incorporated by reference herein) receives the high frequency AC output voltage from converter circuit 17. The power provided to lamps 21 and 23 along lines 31, 33, 35, 37, 39 and 41 is varied by varying the frequency of the high frequency AC voltage applied from DC-AC converter circuit 17 to output circuit 19.

Voltage supply 25 of this application corresponds to voltage supply 40 of the aforementioned Mark W. Fellows et al U. S. patent application Ser. No. 219,923, filed Jul. 15, 1988. Voltage supply 25 provides a prescribed voltage to input "V Supply" of control circuit 27. This voltage, during start-up operation, is the result of a signal received by voltage supply 25 from preconditioner circuit 15. The corresponding voltage received at input "V Supply" from voltage supply 25 "after start-up" is the result of a signal along line 98 from output circuit 19.

Control circuit 27 in response to the voltage applied at input "V Supply" provides a signal on output terminal "V REG" which is used by the system as a regulating voltage.

A signal is produced on input "Start" of control circuit 27 by the charging of capacitor 45 through resistor 43 in response to the output signal "V REG". In response output circuit 19 produces a frequency sweep as described in both U.S. patent application Ser. No. 219,923 and U.S. patent application Ser. No. 358,257 with respect to output circuit 20 of each of those applications. This frequency sweep should lead to the ignition of lamps 21 and 23. The frequency sweep is started in accordance with the signal applied to input "F MIN"

of control circuit 27. This signal is a derivative of the signal at terminal "V REG".

Should the lamps fail to ignite after a prescribed amount of sweep, excessive voltage could be applied to them. To prevent this, after the prescribed amount of sweep, a signal is applied along line 48 from output circuit 19 to signal applying circuit 29 which thereupon applies a signal to input "V LAMP" of control 27. This signal causes the system to discharge capacitor 45 which is then charged again and the above described attempt to ignite the lamps is repeated.

When lamps 21 and 23 ignite, a prescribed voltage is applied along lines 48 from output circuit 19 to signal applying circuit 29. As a result a signal is applied from signal applying circuit 29 to input "C RECT" of control circuit 27. This signal causes the system to decrease the magnitude of the power applied to lamps 21 and 23 and also to control the frequency of the voltage applied to the lamps by controlling the frequency of DC-AC converter circuit 17 in accordance with signals applied to output terminal "GHB".

When lamps 21 and 23 ignite a lamp current signal is applied between lines 46 and 46A. This causes signal applying circuit 29 to provide input signals to inputs "LI1" and "LI2" of control circuit 27 in order to cause the lamp current to remain constant.

Input terminal "I PRIM" is the bottommost input terminal of control circuit 27. It receives a signal along line 47 reflective of the current in the primary transformer of output circuit 19 (see FIG. 2 of the aforementioned Mark W. Fellows et al application Ser. No. 219,923, filed Jul. 15, 1988). The signal along line 47 is also used to control the frequency of DC-AC converter circuit 17 by applying proper gating signals at output terminal "GHB" of control circuit 27.

Another input terminal on control circuit 27 is identified by the term "D MAX". A signal from output terminal "V REG" of control circuit 27 is received at input terminal "D MAX". This signal causes control circuit 27 to vary the duty cycle of preconditioner circuit 15 by changing the signal applied on output terminal "GPC" from control circuit 27.

Input terminal "OV" of control circuit 27 receives a signal from preconditioner circuit 15. This controls the operation of the boost converter in preconditioner circuit 15 during start-up by also controlling the signal applied along output terminal "GPC" from control circuit 27. This control prevents the duty cycle of the boost converter from increasing beyond a desired maximum. By doing so the voltage on the output of preconditioner circuit 15 is limited during start-up.

A signal is also applied to input terminal "CSI" of control circuit 27 which represents the output current of preconditioner circuit 15 during start-up. This signal is used to prevent excessive current transients during start-up and operation. If excessive current is sensed, the duty cycle of preconditioner circuit 15 is decreased in accordance with signals produced at output terminals "GPC" by control circuit 27.

Input terminal "DC" of control circuit 27 also receives an output signal from preconditioner circuit 15. This signal also operates to control the duty cycle signals applied to preconditioner circuit 15 from output terminal "GPC" of control circuit 27. In this way the signal applied to input terminal "DC" operates to maintain the DC output voltage of preconditioner circuit 15 constant.

As is obvious from FIG. 1 terminal "GND" of control circuit 27 provides a ground for the control circuit. A signal representative of rectified AC voltage fed to preconditioner circuit 15 is received at terminal "PF" of control circuit 27. This signal causes control circuit 27 to modify the duty cycle of preconditioner circuit 15 by varying the output from terminal "GPC" of control circuit 27. In this way preconditioner circuit 15 operates at a desired power factor. A capacitor 59 is connected to terminal "DC " of control circuit 27 and serves as a noise filtering element.

Capacitor 210 is connected to output terminal "CP" of control circuit 27 and serves as a timing element. Terminal "CP" is connected to a current source (see FIG. 8 of the aforementioned Mark W. Fellows et al application Ser. No. 219,923, filed Jul. 15, 1988). A comparison is made in control circuit 27 between the output of this current source and a prescribed signal applied to output terminal "DC " and the voltage signal applied to terminal "D MAX". This comparison controls the signal applied by way of output terminal "GPC" for establishing the duty cycle of preconditioner circuit 15.

Terminal "CVCO" of control circuit 27 is connected to capacitor 130 which serves as a filtering element, as well as a timing element. Terminal "CVCO" is also connected in a feedback arrangement through a current source (see FIG. 8 of the aforementioned Mark W. Fellows et al application Ser. No. 219,923, filed Jul. 15, 1988) to control the signals applied to output terminal "GHB" of control circuit 27. These signals control the duty cycle of DC-AC converter circuit 17. In addition, the signal at terminal "CVCO" is compared with the output signal along line 98 from output circuit 19 to control the effective resistance connected between the lines 133 and 134 as shown in FIG. 10 of the aforementioned application Ser. No. 358,257.

The improvement disclosed herein involves the provision of light sensing means connected to terminals 113 and 114 of dimming interface circuit 30. From the aforementioned application Ser. No. 358,257, it will be understood that the voltage applied across terminal 113 and 114 controls the amount of light emanating from fluorescent lamps 21 and 23. A representative circuit for light sensing means 2 is shown in FIG. 2. Light sensing means 2 receives its power for operation from the ballast means shown in FIG. 1 from circuit nodes 113 and 114. Light sensing means 2 comprises a light sensor LS connected between line 114 and one end of a capacitor C. The other end of capacitor C is connected to terminal 113. The one end of capacitor C is also connected to the base of NPN transistor $Q_1$ which acts as a first stage amplifier. The emitter of transistor $Q_1$ is connected to line 114. The base of transistor $Q_1$ is also connected to one end of a variable resistor R whose other end is connected to line 113. The collector of transistor $Q_1$ is connected to one end of a resistor $R_c$ whose other end is connected to line 113. The one end of resistor $R_c$ is also connected to the base of PNP transistor $Q_2$ Transistor $Q_2$ serves as the second stage of the disclosed control circuit. It acts as a current sink. The emitter of this transistor is connected to line 113 while its collector is connected to line 114. A zener diode is also connected across lines 113 and 114 to protect against overvoltages being applied across those lines.

In controlling the backlighting of a liquid crystal display, light sensor LS is placed in a position where it can only sense light incident on the display, or at least a part thereof. It should be so located that the backlighting does not strike it. In response to the light striking light sensor LS it controls the operation of transistor $Q_1$ in accordance with the bias established by variable resistor R. Transistor $Q_1$ in turn, in conjunction with biasing resistor $R_c$ controls the operation of transistor $Q_2$. In operation, the less incident light that strikes light sensor LS the more current transistor $Q_1$ conducts. As a result transistor $Q_2$ sinks more current between terminals 113 and 114. This causes interface circuit 30 to lower the luminescence of lamps 21 and 23. As incident light at the display increases light sensor LS causes transistor $Q_1$ to conduct less current accordingly. This causes transistor $Q_2$ to sink less current between lines 113 and 114 and consequently, interface circuit 30 operates to cause lamps 21 and 23 to increase their luminescence.

FIG. 3 shows a curve in solid line which is the presently desired method of operating such liquid crystal display backlighting lamps. A threshold of light is provided even without light incident on light sensor LS. This remains somewhat constant for an increase in incident light and then increases in accordance with the slope of the solid line curve until it reaches a maximum, whereupon the controlled lamp light output remains constant again regardless of increased light incident on the display. The upper dotted line shows a similar method of controlling the lamp light output except it starts at a higher threshold and has a less steep slope from that higher threshold to the maximum light output. The lower dotted curve starts at a lower threshold but increases continuously until it gets to the maximum lamp output.

It should be apparent that various modification of the above will be evident to those skilled in the art and the arrangement described herein is for illustrative purposes and is not to be considered restrictive.

What is claimed is:

1. A method of controlling the amount of luminescence provided by a lamp used for backlighting a liquid crystal display including sensing the amount of light incident on said display other than that provided by said lamp and increasing the luminescence provided by said lamp as said incident light increases wherein said luminescence increases from a minimum threshold, which minimum threshold is held constant until said incident light reaches a given minimum.

2. A method of controlling the amount of luminescence provided by a lamp according to claim 1, wherein said luminescence increases from said minimum threshold to a maximum in a predetermined manner as said incident light increases.

3. A method of controlling the amount of luminescence provided by a lamp according to claim 2, wherein said minimum threshold is held constant until said incident light reaches a given minimum.

4. A method of controlling the amount of luminescence provided by a lamp according to claim. 2, wherein said luminescence increases constantly to said maximum as said incident light increases.

5. A method of controlling the amount of luminescence provided by a lamp in accordance with any one of claims 1, 2 or 4 wherein said lamp is a fluorescent lamp.

6. A sensing circuit from a fluorescent lamp connected to a ballast means for said fluorescent lamp which ballast means includes a light control circuit, said sensing circuit including a light sensor which produces a signal representative of incident light impinging upon it, said sensing circuit being operable from power derived from said ballast means and controlling said light control circuit to increase the luminescence of said fluorescent lamp as said incident light increases.

7. A control circuit for a fluorescent lamp connected to a ballast means for said fluorescent lamp, said ballast means having two circuit nodes, said control circuit including a light sensor which produces an output signal representative of light striking it, a first stage amplifier, said light sensor being connected to said first stage amplifier which amplifies the output signal of said light sensor, said first amplifier having an output, a second stage connected to the output of said first stage amplifier, said second stage operating as a current sink and connected to said ballast means to increase the light from said fluorescent lamp as said light striking said light sensor increases, said control circuit being connected to said two circuit nodes of said ballast means and receiving operating power for its entire operating cycle from said circuit nodes.

8. A control circuit for a fluorescent lamp as claimed in claim 7, wherein said first stage amplifier is an NPN transistor.

9. A control circuit for a fluorescent lamp as claimed in claim 8, wherein said second stage current sink is an PNP transistor.

10. A sensing circuit for a fluorescent lamp connected to a ballast means for said fluorescent lamp which ballast means includes a light control circuit, said sensing circuit including a light sensor which produces a signal representative of incident light impinging upon it, said sensing circuit controlling said light control circuit to increase the luminescence of said fluorescent lamp as said incident light increases, wherein said sensing circuit maintains a minimum threshold luminescence until said light sensor signal indicates that a given minimum of incident light is impinging on it.

11. A sensing circuit for a fluorescent lamp according to claim 10, wherein said sensing circuit increases said luminescence from said minimum threshold to a maximum in a predetermined manner as said signal from said light sensor increases with increasing incident light

12. A sensing circuit for a fluorescent lamp according to claim 11, wherein said sensing circuit maintains said minimum threshold luminescence until said light sensor signal indicates that a given minimum of incident light is impinging on it.

13. A sensing circuit for a fluorescent lamp according to claim 11, wherein said sensing circuit increases said luminescence constantly as said signal from said light sensor increases.

* * * * *